United States Patent [19]

Su

[11] Patent Number: 5,025,204

[45] Date of Patent: Jun. 18, 1991

[54] CURRENT MIRROR USING RESISTOR RATIOS IN CMOS PROCESS

[75] Inventor: David K. Su, San Jose, Calif.

[73] Assignee: Hewlett-Packard Company, Palo Alto, Calif.

[21] Appl. No.: 461,209

[22] Filed: Jan. 5, 1990

[51] Int. Cl.[5] ..... G05F 1/575

[52] U.S. Cl. ..... 323/274; 323/273

[58] Field of Search ..... 323/273, 274, 275, 277

[56] References Cited

U.S. PATENT DOCUMENTS

| | | | |
|---|---|---|---|
| 4,019,096 | 4/1977 | Bullinga | 323/277 |
| 4,251,743 | 2/1981 | Hareyama | 323/273 |
| 4,404,473 | 9/1983 | Fox | 323/274 |

*Primary Examiner*—Steven L. Stephan

*Assistant Examiner*—Jeffrey Sterrett

[57] ABSTRACT

An operational amplifier drives the gate of a voltage controlled variation resistor having a source terminal coupled in series to a reference voltage through a current sense resistor and a drain terminal coupled in series to a supply voltage via a current regulated component, e.g., a light emitting diode. Voltage across the current sense resistor feeds back to the inverting input of the operational amplifier. The non-inverting input receives a substantially constant voltage corresponding to a target voltage, the voltage at the current sense resistor when the desired current flows therethrough. The operational amplifier varies the resistance of the variation resistor to maintain the target voltage at the current sense resistor and establish the desired current flow.

4 Claims, 2 Drawing Sheets

CURRENT MIRROR USING RESISTOR RATIOS IN CMOS PROCESS

The present invention relates generally to current control devices, and particularly to a current control device well adapted for consistent operation even across low voltages.

BACKGROUND OF THE INVENTION

A current control device maintains a given magnitude of current along a particular current path, e.g., a series combination of circuit components. Conventional current control devices typically require either a minimum potential across terminal leads, or react undesirably to slight variation in circuit parameters, e.g., deviation from expected power supply voltage or expected component characteristics.

One use of a current control device is driving a light emitting diode (LED), a common display device for electronic products. The brightness of an LED is a function of the amount of current passing through the LED. To control the brightness of an LED then, it is sufficient to control the magnitude of current passing through the LED. To provide consistent LED brightness, a consistent magnitude of current must pass through the LED.

A number of LED display devices connected in series have a desired level of brightness by controlling the amount of current passing through the series combination. As a diode, however, the voltage drop across an LED is substantially independent of the current it carries. Much of the potential across the LED series combination, therefore, can be taken by voltage drops across the LED display devices. As a result, less voltage potential remains across the current control device, and its operation may be impaired if this remaining potential is insufficient.

This is particularly critical when, for example, a relatively small supply voltage is used to drive a series combination of LED display devices. A conventional current mirror placed in series with an LED provides current control substantially independent of the voltage drop, i.e., forward voltage, of the LED. However, a simple current mirror, for example, an n-channel MOS-G device, typically requires at least 2 volts across its drain and source terminals for proper operation. For a 5 volt supply voltage and a pair of series coupled LED display devices, each having a 2 volt forward biased voltage, only 1 volt remains across the current mirror for current control, and the device cannot operate as desired. It is, therefore, desirable that a current control device operate with a small potential across its terminal leads.

A second current control approach uses an output transistor in its linear mode with a resistor circuit for setting current flow through the transistor. While this approach is less sensitive to the potential across the transistor, it is quite sensitive to variation in the supply voltage, LED forward voltage, and absolute resistor values obtained. A slight variation in these circuit parameters can result in significant variation in LED brightness.

Some applications require an array of adjacent LED devices. Each LED of the array is desirably of substantially identical brightness when activated. For example, if the LED array is part of a seven segment display, it is desirable that each segment of the display appear with matching brightness. Also, some laser printers use an array of hundreds of LED light sources, and the quality of printed output obtained depends on consistency of LED brightness. To accomplish consistent LED brightness, currents of substantially matching magnitude must pass through each LED.

SUMMARY OF THE INVENTION

It is, therefore, an object of the present invention to provide precise current control with small voltage potentials across the terminal leads of the current control device.

Another object of the present invention is to obtain current control as a function of resistor ratios. As an integrated circuit, where such resistor ratios are precisely obtained, a current control device in accordance with the present invention can provide a number of separate current paths of substantially matching magnitude.

It is a further object of the present invention to provide current control in an LED light source substantially independent of LED forward voltage, but operational with very little potential across the leads of the current control device.

In a principal embodiment of the present invention, the foregoing objects are achieved by a current control device providing a current path, including a series combination of a voltage controlled variation resistor and a current sense resistor. The current sense resistor and voltage controlled variation resistor lie in a series combination with a circuit component through which current flow is to be controlled. The series combination couples a first voltage and a second voltage, e.g., a supply voltage and a reference voltage. The current control device further includes an operational amplifier providing its output to the gate of the voltage controlled variation resistor, and having a first one of its inputs tied to the interconnection of the current sense resistor and the voltage controlled variation resistor. The second input of the operational amplifier is tied to a substantially fixed voltage signal.

The resistance of the current sense resistor is selected to provide a target voltage across its terminals when a desired magnitude of current passes therethrough. The constant voltage signal applied to the second input of the operational amplifier is maintained substantially at the target voltage. The operational amplifier acts to vary the resistance of the variation resistor to maintain the target voltage across the current sense resistor and thereby establish the desired current flow.

The subject matter of the present invention is particularly pointed out and distinctly claimed in the concluding portion of this specification. Both the organization and method of operation of the invention, together with further advantages and objects thereof, however, may best be understood by reference to the following description and accompanying drawings wherein like reference characters refer to like elements.

DETAILED DESCRIPTION OF A PREFERRED EMBODIMENT

Figure 1:
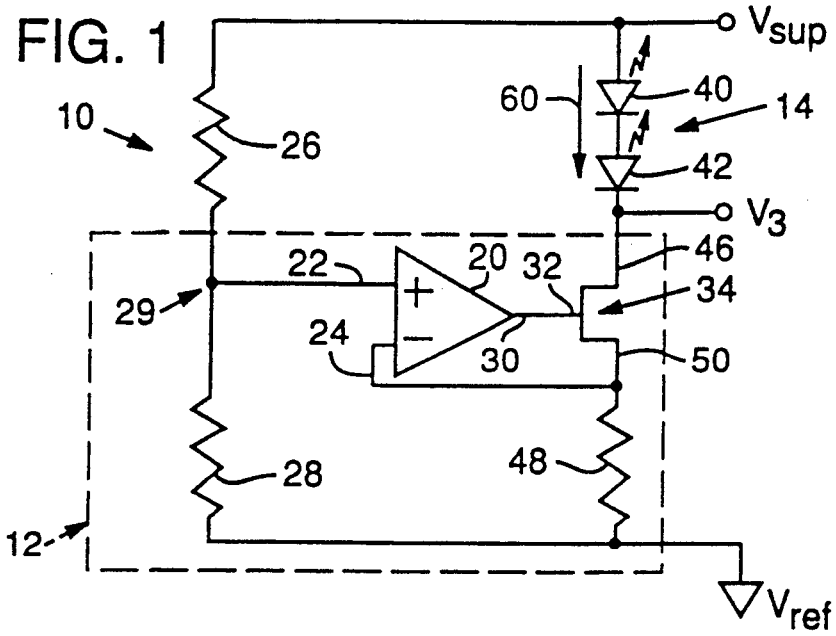
FIG. 1 is a schematic illustration of an integrated circuit current control device in accordance with the present invention as used for discrete LED control.

FIG. 1 is a schematic illustration of a current control device 10, according to the present invention, as used for discrete light emitting diode (LED) current control. Device 10 includes an integrated circuit 12 and an external resistor 26 for providing a predetermined magnitude of current through LED display element 14. The magnitude of current passing through LED display element 14 determines the brightness of element 14. Thus, by controlling current, device 10 controls the brightness of display element 14.

Integrated circuit 12 includes an operational amplifier 20, poly-silicon current set resister 28, poly-silicon current sense resistor 48, and an n-channel MOS transistor 34. The operational amplifier 20 includes a non-inverting input terminal 22 and an inverting input terminal 24. Resistors 26 and 28 couple in series to provide a voltage divider 29 between supply voltage Vsup and a ground or reference voltage Vref, with resistor 26 connected to voltage Vsup and resistor 28 connected to voltage Vref. The point of interconnection between resistors 26 and 28 connects to non-inverting input terminal 22 of operational amplifier 20. Thus, non-inverting input terminal 22 of amplifier 20 receives a substantially constant voltage signal derived as a proportion of the potential of voltage Vref relative to voltage Vsup.

Output terminal 30 of operational amplifier 20 drives gate 32 of transistor 34, acting as a voltage controlled variation resistor. Display element 14 comprises LED 40 and LED 42 connected in series, with the cathode of LED 40 coupled to the anode of LED 42. The anode of LED 40 connects to supply voltage Vsup, and the cathode of LED 42 connects to drain terminal 46 of transistor 34. Resistor 48 couples source terminal 50 of transistor 34 to voltage Vref. Also, source terminal 50 of transistor 34 connects as feedback to inverting input terminal 24 of operational amplifier 20.

A current path 60 between supply voltage Vsup and reference voltage Vref exists along the series combination of forward biased diodes 40 and 42, terminals 46 and 50 of transistor 34, and resistor 48. The resistance of current path 60 is a function of the resistance of resistor 48 plus the drain-to-source resistance of transistor 34. Because transistor 34 acts as a voltage controlled variation resistor, its resistance is determined by the voltage present at output terminal 30 of amplifier 20. The resistance of path 60, and particularly that of transistor 34, then varies in accordance with the output of amplifier 20.

The high gain of operational amplifier 20 keeps the voltage at input terminals 22 and 24 essentially equal. The current through resistor 28 is thereby mirrored proportionally into the resistor 48, each resistor coupling essentially the same potential to voltage Vref. The ratio between the respective currents in resistors 28 and 48 is then a function of the relative resistance of resistors 28 and 48. It may be appreciated that the relative current in resistors 28 and 48 is independent of the absolute values of resistors 28 and 48. Thus, resistors 28 and 48 are advantageously implemented in integrated circuit 12, where the task of providing a given resistor ratio is more accurately achieved than providing particular absolute resistor values.

By making the value of external resistor 26 large relative to that of resistor 28, the current through resistor 28, and therefore the current along path 60, is determined essentially by the value of an external component. By fabricating the relatively small resistor 28 as part of integrated circuit 12 and using the larger resistor 26 as an external resistor, little material resources, i.e. chip fabrication resources, are required for implementation of voltage divider 29.

The value of resistor 48 is chosen to allow passage of a desired LED current Iled along path 60, corresponding to a desired LED brightness, when a given potential V1 exists across resistor 48. With reference to an assumed value for supply voltage Vsup, the values of resistors 26 and 28 are chosen to provide the same potential V1 at input terminal 22 of amplifier 20.

Transistor 34 provides, when fully turned on, a minimum on-resistance equal to a given potential V2 divided by the desired current Iled. Thus, where transistor 34 is fully turned on and the actual voltage V3 across integrated circuit 12, i.e., across the series combination of transistor 34 and resistor 48, equals the sum of the given voltages V1 and V2, the desired current Iled flows through diodes 40 and 42. As discussed more fully hereafter, where V1 and V2 are each on the order of 0.2 volts, integrated circuit 12 operates with as little as 0.4 volts at the drain terminal 46 of transistor 34.

Generally, the actual voltage V3 at drain terminal 46 of transistor 34 is a function of the supply voltage Vsup minus the substantially fixed voltage drop across diodes 40 and 42. Thus, voltage V3 is subject to variation depending on the actual value of supply voltage Vsup and actual forward voltage drop of LED 40 and LED 42. In accordance with the present invention, the resistance of transistor 34 is compensated to adjust current flow in path 60 to be substantially equal to the desired current Iled. More particularly, change in voltage V3 at drain terminal 46 of transistor 34 results, by way of feedback through amplifier 20, in a change in resistance of transistor 34, such that transistor 34 carries a greater or lesser voltage drop. As the actual voltage V3 increases, the voltage at source terminal 48 is urged toward an increase, and the inverting input terminal 24 of amplifier 20 receives a slightly greater input voltage. As a result, the potential of output terminal 30 drops in accordance with the high gain of amplifier 20. The resistance of transistor 34 then increases, and transistor 34 carries a larger proportion of the voltage V3. Similarly, if the voltage V3 decreases, the voltage at output terminal 30 increases and transistor 34 carries a smaller portion of voltage V3.

In this manner, amplifier 20 keeps the voltage at its input terminals 22 and 24 substantially equal to voltage V1. The voltage across resistor 48 then remains substantially at the desired voltage V1. With the voltage V1 across the resistor 48, the current along path 60 is substantially equal to the desired current Iled and the desired LED brightness is achieved.

The utility of the present invention is evident in an installation having a small supply voltage Vsup, e.g., 5 volts, and a substantial voltage drop across the series combination of LED 40 and LED 42, e.g., a voltage drop on the order of 4 volts. For a desired current Iled on the order of 0.011 amps, resistor 48 can be approximately 20 ohms, establishing voltage V1 at approximately 0.2 volts. Transistor 34 is designed to provide approximately 20 ohm resistance when fully turned on, setting voltage V2 also at approximately 0.2 volts. Accordingly, resistor 26 should be approximately 10 k ohms, and resistor 28 approximately 460 ohms, to deliver approximately 0.2 volts to input terminal 22 of operational amplifier 20. In an actual implementation, supply voltage Vsup and the voltage drop across LED 40 and LED 42 can vary from their expected values. Despite such variation, current control device 10 as implemented with the above component values, compensates by providing an LED current along path 60 substantially equal to 0.011 amps.

Consider, for example, an actual supply voltage Vsup of 4.8 volts and a combined voltage drop across diodes 40 and 42 of 4.4 volts. The potential V3 at drain terminal 46 is then 0.4 volts. Operational amplifier 20 drives the voltage at its output terminal 30 toward supply voltage Vsup, in this case 4.8 volts, until the on-resistance of transistor 34 is low enough to keep the drain-to-source voltage of transistor 34 at about 0.2 volts, thereby leaving the remaining 0.2 volts across resistor 48. The desired current Iled thereby passes through LED 40 and LED 42.

If, on the other hand, supply voltage Vsup is actually 5.25 volts and the combined voltage drop across diodes 40 and 42 is 3.6 volts, then the potential V3 at drain terminal 46 of transistor 34 is 1.65 volts. With the potential across resistor 48 urged toward 0.2 volts by terminal 24 of operational amplifier 20, the remaining 1.45 volts must be taken by transistor 34. The voltage at the output terminal 30 of amplifier 20 moves in the required direction to adjust the resistance of transistor 34 to take the remaining potential. The circuit tends toward stabilization where the potential across resistor 48 equals the potential at non-inverting input terminal 22. Transistor 34 thereby changes in resistance in order to carry the potential necessary to leave the potential across resistor 48 at the desired voltage V1.

Proper operation of device 10 is substantially independent of the voltage drop across LED 40 and LED 42, provided a minimum voltage V3 remains across integrated circuit 12, i.e., sufficient voltage at drain terminal 46 of transistor 34. In the embodiment of FIG. 1, a voltage V3 as low as approximately 0.4 volts is sufficient for the desired current control. Variation of transistor characteristics due to temperature and process variation is also substantially removed.

Remaining sources of error include mismatches between resistors 28 and 48, variation in power supply, the absolute value of resistor 28, offset voltage of operational amplifier 20, and the tolerance of external resistor 26. However, mismatch between resistors 28 and 48 is substantially less than the typical 30% absolute value variation due to process and is calculated to result in only approximately 5% variation in LED brightness. Absolute value of resistor 28 should have negligible effect where its resistance is much less than that of resistor 26. Accordingly, it is suggested that external resistor 26 have 1% variation relative to its specified value to minimize error. Offset voltage of operational amplifier 20 will cause a difference between voltages at input terminals 22 and 24. Amplifier 20 should be designed with no systematic offset, but random offset of approximately 0.005 volts can be expected. Overall current variation due to the above noted sources of error is calculated to be on the order ±20%. Such variation in current magnitude is considered small in light of the broad range of variables, such variation in supply voltage Vsup and LED forward voltage, in which device 10 operates.

Figure 2:
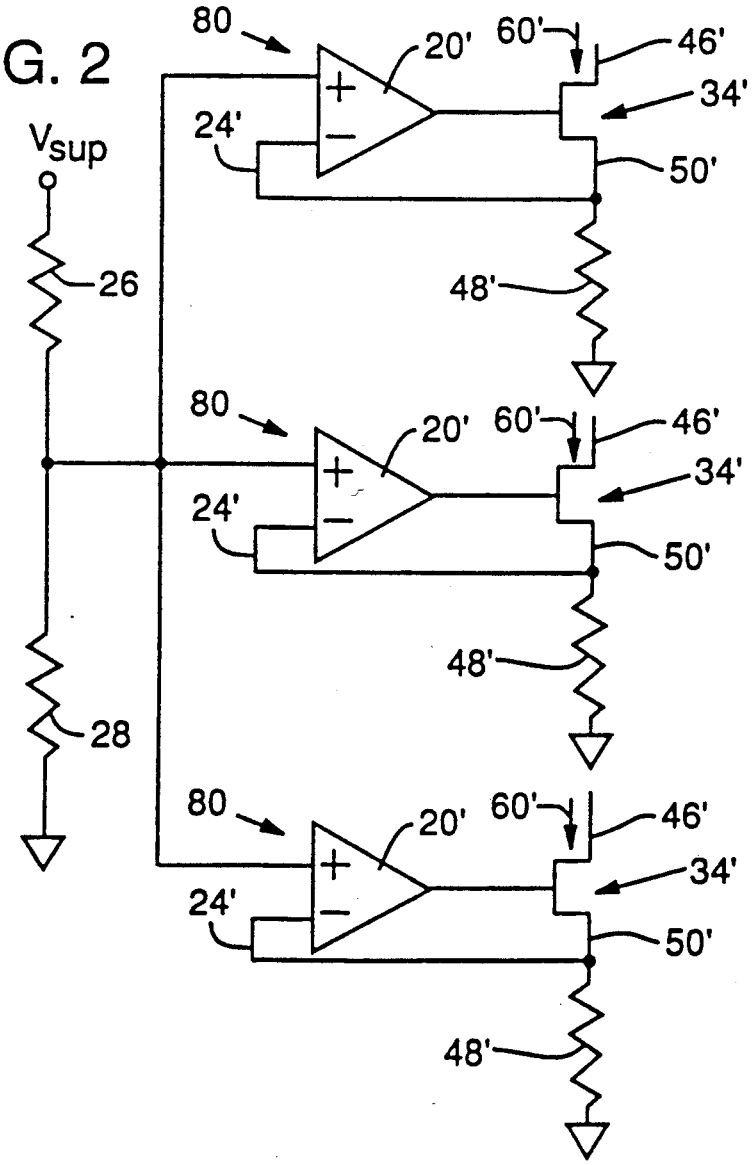
FIG. 2 is a schematic illustration of a current control device in accordance with the present invention as used for providing a plurality of substantially identical or matching current outputs.

FIG. 2 illustrates a second current control arrangement, according to the present invention, where a number of similar current control devices 80 each provide substantially equal or matching current outputs Io. In FIG. 2, each control device 80 includes an operational amplifier 20', a transistor 34', and a current sense resistor 48'. As with device 10, one terminal of current sense resistor 48' connects to source terminal 50' of transistor 34' and connects as feedback to inverting input terminal 24' of amplifier 20'. The remaining terminal of resistor 48' connects to reference voltage Vref. A current path 60' between drain terminal 46' of transistor 34' and reference voltage Vref provides each current output Io. The interconnection of resistors 26 and 28 provides a voltage input for each of the non-inverting input terminals 22' of the amplifiers 20'. As previously described, the voltage across resistor 28 establishes a similar voltage across each resistor 48', whereby the magnitude of current through resistor 28 is mirrored proportionally through each resistor 48'. Again, this proportionate mirroring of current does not depend on the absolute values of resistors 28 and 48', rather it depends on the ratio of resistance of resistor 28 to that of resistors 48'. Because resistors 28 and 48' may be implemented in a single integrated circuit, or in integrated circuits of substantially identical composition, precise resistance ratios are possible. Therefore, precise current control is possible. More particularly, very close matching among current outputs Io is achieved.

Error, or mismatch, in current output is calculated as the potential range of current Io variation for devices 80 (dIo) divided by the desired current output (Io). More particularly, $$\frac{dIo}{I} \approx \frac{dR48}{R48} + \frac{dVx}{Vx} \approx \frac{dL}{L} + \frac{dVy}{Vx}$$

where dL is the possible difference in poly-silicon resistor width for resistors 48, dVx is the possible difference in voltage across resistor 28, and dVy is the possible difference in operational amplifier offset voltage. Typically dL equals approximately 0.1 um, L equals approximately 20 um, dVy equals approximately 0.01 volts, and Vx equals approximately 1 volt. The expected mismatch in current outputs Io is calculated to be only approximately 1.5%.

Figure 3:
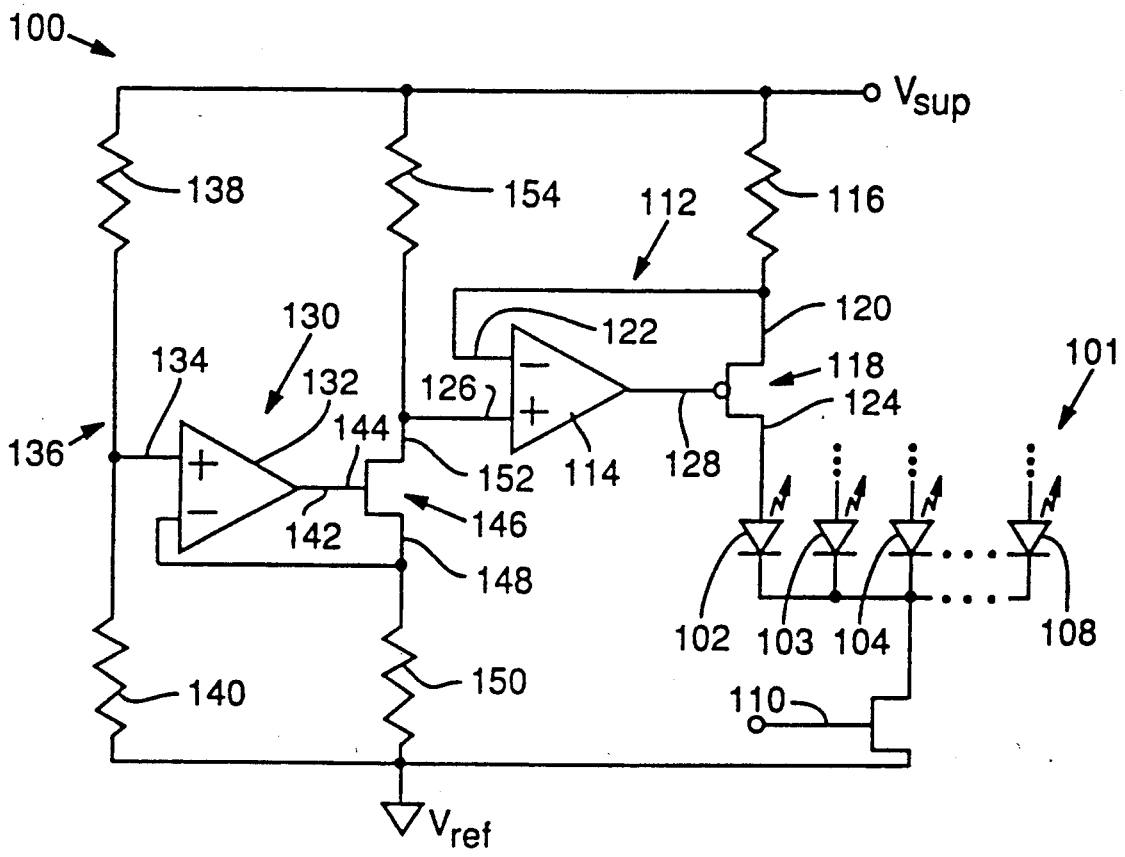
FIG. 3 is a schematic illustration of a current control device in accordance with the present invention as used for current control in connection with a seven segment display device.

FIG. 3 illustrates a current control device 100 allowing for matching brightness between discrete LED elements or segments of a seven segment display 101. Providing consistent LED current in a seven segment display can be difficult because voltage across the display elements often varies, depending on which display elements are currently activated. A current control device in accordance with the present invention, however, maintains a substantially constant LED current despite variations in voltage potential.

Seven segment display 101 includes light emitting diodes 102–108. In accordance with conventional multiplexing schemes for such seven segment displays, various ones of the light emitting diodes 102–108 couple to reference voltage Vref by way of certain digit switches. For example, the digit switch 110 couples the diodes 102, 103, 104 and 108 to voltage Vref. When digit switch 110 is enabled, diodes 102, 103, 104 and 108 are illuminated to form a particular digit or portion of a digit. Thus, by selectively enabling various digit switches, various digits are displayed on the seven segment display.

For purposes of illustration, only the single digit switch 110 and diodes 102, 103, 104 and 108 are shown. It will be understood, however, that additional digit switches, similar to digit switch 110, are necessary to provide the necessary combinations of diode illumination.

Each of diodes 102–108 in the seven segment display 101 is placed in a series combination with a separate current control device. In FIG. 3, a current control device 112 for driving LED 102 is shown. However, it will be understood that an additional device similar to current control device 112 is required for each of diodes 103–108. The current device 112 includes an operational amplifier 114, a current sense resistor 116, and a p-channel MOS transistor 118. The output terminal of amplifier 114 drives gate terminal 128 of transistor 118. Resistor 116 connects to supply voltage Vsup and to terminal 120 of transistor 118. The point of interconnection between resistor 116 and terminal 120 is connected as feedback to the inverting input terminal 122 of operational amplifier 114. Terminal 124 of transistor 118 connects in series through diode 102 and digit switch 110 to reference voltage Vref.

It may be appreciated that the current control device 112 operates in a substantially similar manner as that of the previously described current control devices 10 and 80. More particularly, and as will be described more fully hereafter, a substantially constant voltage signal is applied to the non-inverting input 126 of operational amplifier 114. This substantially constant voltage signal corresponds to a voltage which would be present at the interconnection of resistor 116 and terminal 120 when the desired magnitude of current flows through resistor 116. As the voltage present at the interconnection of resistor 116 and transistor 118 varies, operational amplifier 114 drives the gate 128 of transistor 118 to vary the resistance of transistor 118 and thereby adjust current flow through the diode 102 to the desired magnitude.

Because transistor 118 is a p-channel device, a level shifting circuit 130 is used to apply the substantially constant voltage signal to the non-inverting input terminal 126 of operational amplifier 114. This level shifting circuit 130 operates in a manner substantially similar to that of the previously described current control devices.

Level shifting circuit 130 includes an operational amplifier 132 having its non-inverting input terminal 134 tied to the output of a voltage divider 136. Voltage divider 136 includes a series combination of resistor 138 and resistor 140 connecting supply voltage Vsup and reference voltage Vref.

Output terminal 142 of operational amplifier 132 drives gate 144 of an n-channel MOS transistor 146. Source terminal 148 of transistor 146 couples to voltage Vref by way of resistor 150, while the drain terminal 152 of transistor 146 couples to supply voltage Vsup by way of resistor 154. In this manner, a substantially constant voltage signal, shifted up toward voltage Vsup, is provided at drain terminal 152 of transistor 146. Drain terminal 152 of transistor 146 connects to non-inverting input terminal 126 of operational amplifier 114.

By suitably selecting component values, as previously described, the substantially constant voltage signal present at the drain terminal 152 of transistor 146 corresponds to the target voltage across the resistor 116, i.e. that voltage present at the interconnection of resistor 116 and terminal 120 of transistor 118 when the desired current magnitude passes through resistor 116. Because only one LED display segment is used for each segment of display 101, a larger voltage drop across each such device 112 is generally available. Accordingly, the voltage drop across the current sense resistor 116 is selected to be approximately 0.4 volts to minimize error due to operational amplifier offset voltage. Even with the additional stage of level shifting provided by circuit 130, the current control device 110 operates with as little as ±25% variation in LED current.

Thus, a precise current control device has been shown. The current control device is well suited for implementation in integrated circuits, and particularly in MOS circuitry. As used for driving LED displays, current control is substantially independent of LED forward voltage, but is operational with very little voltage across the integrated circuit. Furthermore, and more importantly, this approach to current control depends on matching of on-chip resistance instead of obtaining particular absolute resistance values.

While a preferred embodiment of the present invention has been shown and described, it will be apparent to those skilled in the art that many changes and modifications may be made without departing from the invention in its broader aspects. The appended claims are, therefore, intended to cover all such changes and modifications as fall within the true scope of the invention.

I claim:

1. A current control device for establishing a controlled current through an LED wherein the magnitude of the current through the LED is proportional to a reference current through a reference current sense resistor, the current control device comprising:

a series combination of circuit elements including a controlled current sense resistor and a variation resistor responsive to a control signal applied to a control terminal thereof, the series combination being adapted for series coupling with said LED and between first and second voltage terminals; and operational amplifier means having an output terminal coupled to said control terminal for providing said control signal, a first input terminal coupled to a sense point on said series combination, and a second input terminal receiving a substantially constant voltage signal corresponding to a voltage present at said sense point when the desired magnitude of current passes through said sense resistor, said substantially constant voltage signal being provided by a voltage divider network including first and second series coupled resistive elements;

wherein the reference current sense resistor is connected between the second operational amplifier input terminal and one of the first and second voltage terminals and wherein the current sense resistor and the second series coupled resistive elements are both fabricated in integrated circuit form so that a desired ratio of resistances therebetween may be accurately set.

2. The current control device according to claim 1, wherein said variation resistor comprises transistor means operable as a voltage controlled variation resistor with a gate terminal of said transistor means being coupled to the output of said operational amplifier and first and second current path terminals of said transistor means forming a portion of said series combination.

3. The current control device according to claim 2, wherein said transistor means comprises an n-channel MOS transistor having gate, drain, and source terminals, said first voltage terminal comprises a voltage supply terminal, said second voltage terminal comprises a reference voltage terminal, said controlled current sense resistor coupled the source terminal of said transistor to said reference voltage, said sense point is the interconnection of the sense resistor and the source terminal and is tied to an inverting input terminal of said operational amplifier, a non-inverting input terminal of said operational amplifier connects to said reference current sense resistor, and the drain terminal couples through said current controlled circuit element to the supply voltage.

4. The current control device according to claim 2, wherein said transistor means comprises a p-channel MOS transistor having gate, drain, and source terminals, said second voltage terminal comprises a voltage supply terminal, said first voltage terminal comprises a reference voltage, said controlled current sense resistor couples the drain terminal of said transistor to said second voltage terminal, said sense point is the interconnection of the sense resistor and the drain terminal and is tied to an inverting input of said operational amplifier means, the non-inverting input of the operational amplifier means connects to said reference current sense resistor, and the source terminal couples through said current controlled circuit element to the first voltage terminal.

* * * * *